United States Patent [19]

Crine

[11] Patent Number: 4,834,253

[45] Date of Patent: May 30, 1989

[54] RECYCLING CONTAINER UNIT

[76] Inventor: David R. Crine, 33 E. Oak St., Basking Ridge, N.J. 07920

[21] Appl. No.: 186,085

[22] Filed: Apr. 25, 1988

[51] Int. Cl.[4] ..... B65D 91/00

[52] U.S. Cl. ..... 220/1 T; 220/23.4; 220/23.83

[58] Field of Search ..... 220/1 T, 22, 23.83, 220/23.86, 4 C, 21, 23.4

[56] References Cited

U.S. PATENT DOCUMENTS

| | | | |
|---|---|---|---|
| 2,736,454 | 2/1956 | McConnell | 220/22 X |
| 3,384,260 | 5/1968 | Buffington | 220/23.83 X |
| 3,526,334 | 9/1970 | Ashton et al. | 220/23.83 |
| 3,904,218 | 9/1975 | Kostic | 220/23.4 X |
| 4,646,628 | 3/1987 | Lederman | 220/22 |
| 4,739,894 | 4/1988 | Pender | 220/1 T |

*Primary Examiner*—Steven M. Pollard
*Attorney, Agent, or Firm*—William T. Hough

[57] ABSTRACT

In a preferred embodiment, a recycling container unit that includes an upright outer open-top vessel and several insertable upright inner open-top vessels seated within space of the outer vessel, intermittently detachably attached to the wall of the outer vessel by mated male and female members, and the outer vessel having spacing-structure extending upwardly from the inner upper surface of the bottom of the outer vessel positioned to space the seated inner vessels from one-another when mounted within the inner space of the outer vessel, each of the inner and outer vessels including handles accessible when the inner vessels are seated within the outer vessel, the shape of the bottom surface of the floor of the inner vessel corresponding in shape to the seating portion of the upper surface of the inside floor of the outer vessel, and the bottom surface of the bottom of the outer vessel corresponding in shape to the upper surface of the bottom of the outer vessel, and the inner and outer vessel's inner and outer walls and interior spaces each being tapered from a top larger cross-section to a smaller bottom cross-section, the shapes of the tops of the outer and inner vessels and of the outer vessel's open tops, being such that the inner vessels are seated in side-by-side upright relationship within the outer vessel allowing empty outer vessels to be stacked and allowing empty inner vessels to be stacked.

21 Claims, 4 Drawing Sheets

FIG. 1
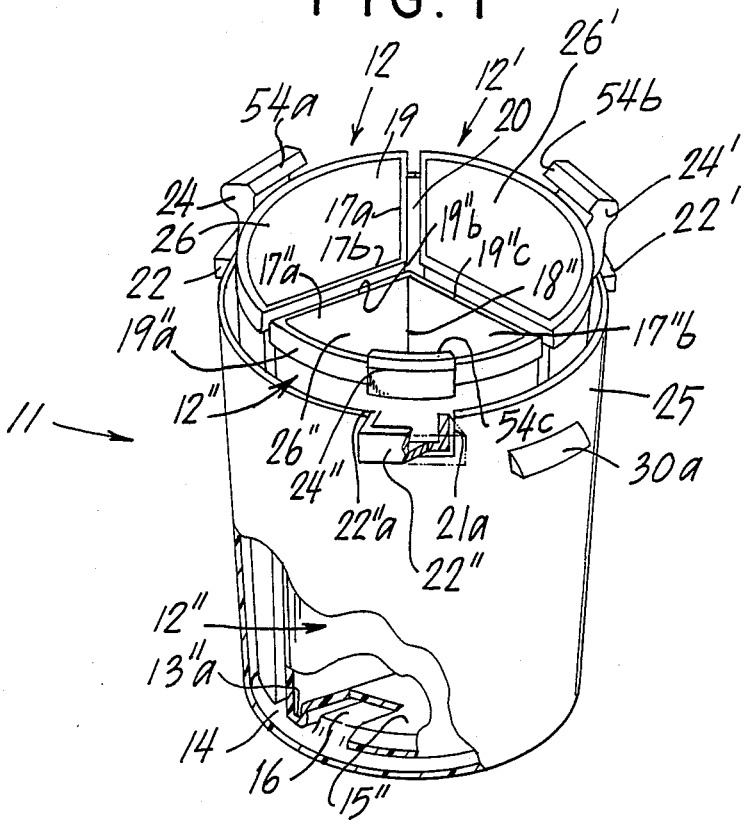
FIG. 9
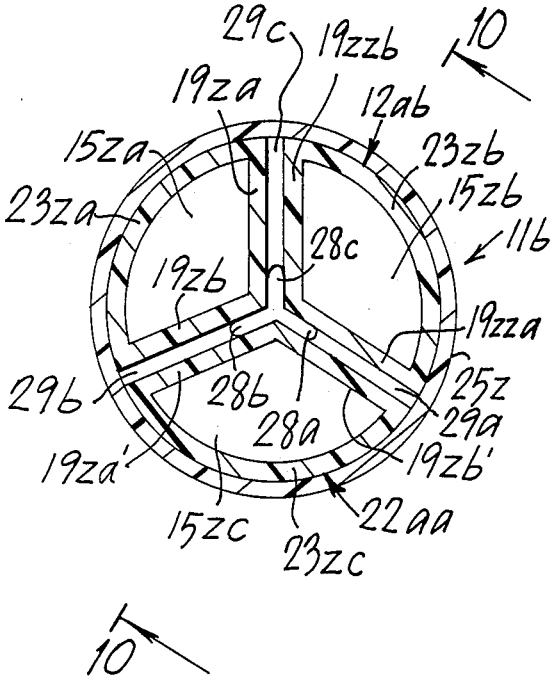
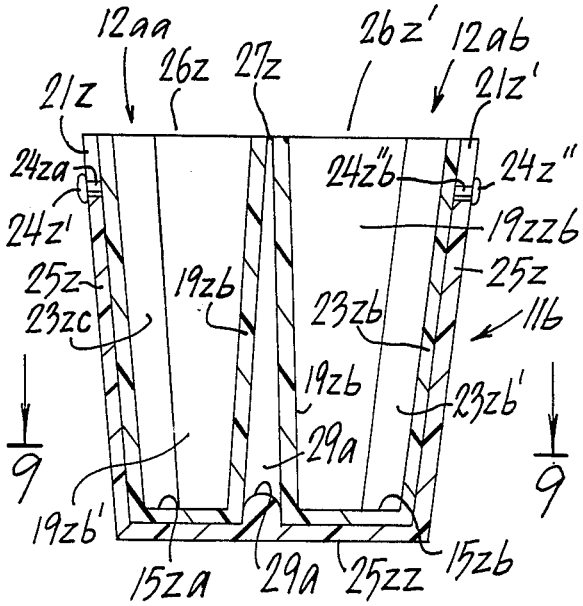
FIG. 10

RECYCLING CONTAINER UNIT

This invention is directed to a novel recycling container unit for storing different categories of debris in different sub-containers, preliminary to the pick-up by the recycling government agency.

BACKGROUND

Prior to the present invention, there existed in nearly ever metropolitan area an ever increasing problem of refuse removal and disposal. So great a problem is this, that minicipal, county and state governments are enacting into law mandatory separation of materials such as glass, aluminum, tin, plastics and paper apart from the normal waste stream. Failure to comply with these ordinances or laws can subject an individual or business to stiff fines and penalties.

As during the years of the World Wars, Americans are being instructed to recycle virtually everything that in the past was merely put out to waste. State governments are passing on to local municipalities the responsibility and power to establish customized recycling programs for their individual communities.

The inevitable goal for each of these communities is to collect as many separated materials as possible and sell them to processing manufacturers for the best price available. This insures a successful and profitable recycling program for each individual municipality. To acquire premium dollar value, all of the recycled materials must be completely separated item by item before they are delivered to the processing facitily(ies). To accomplish this, the communities are in turn passing the bulk of the separating responsibility onto the individual households and businesses who create the waste.

Hence, this puts the complete burden on the consumer to collect and separate as many as eight different materials within the confines of the home and/or office. Thus, there exists an incredible perplexing problem for the average American consumer, who, while habitually wastefull by nature, must conform to this radical change in lifestyle as swiftly and conveniently as possible.

As a typical part of the problems faced in both the home and the office environment, it is not aesthetically pleasing to have various bins or open boxes or cans spread throughout the home or facility, apart from the problem of space. Yet, it is certainly unpleasant and not practical to mix above-noted articles such as glass and/or plastic bottles and/or metal cans together with common garbage and thereafter be faced with the unpleasant task of sifting through the mess to segregate the items into separate containers. Thereafter or concurrently there is the additional problem of how large or small the containers can practically be and how they are to be transported when filled, and likewise, where multiple containers are required periodically, where and how are the empties stored in as little space as possible?

Also, there is the problem of accessory elements or parts, and potential loss of one or more of them, if a combination involves an integral combination. Also, for a combination of multiple vessels, accessibility of openings of the vessels is clearly a major consideration, non-accessible or small or awkwardly placed opening adding to the problems of conveniency of placing items into the several different vessels, as well as the consideration of whether such combinations would constitute an eyesore, distasteful in appearance.

While efforts have been made to approach and solve some of these problems and difficulties, heretofore nothing satisfactory has been available.

Particularly for collection and segregation on a continuing use of a collecting device typically in the small kitchen or closet or cabinet of a kitchen-counter, as well as transportability of the filled units, raises still more serious problems and limitations to be overcome for the home. Clearly, such collection device(s) or unit(s) must be compact and small in size to have any practical value or use.

PRIOR ART

U.S. Pat. No. 4,114,766 patented Sep. 19, 1978, discloses what appears to be a single large container with an end-flap 22 that can be opened for removing refuse from several different compartments separated by consecutive spaced-apart panels such as 14 and 15 that are slidable by slide plates 21 to and from the end opening closed by end-flap 22.

U.S. Pat. No. 992,006 patented May 9, 1911 likewise discloses a large compartmented refuse bin apparently more adaptable to large industrial use, again being a single compartmented vessel.

U.S. Pat. No. 3,893,615 patented July 8, 1975 discloses a cabinet-type bin having separate side-doors to respective severally adjacent open-topped spaces each having a separate liftable pivoted closure-lid, with each space having a trash bag-mounting mechanism for separate trash bags.

OBJECTS

Accordingly, objects of the present invention include the overcoming or avoiding of one or more of the problems and difficulties of the types discussed-above, together with the obtaining of novel advantages hereafter disclosed.

A particular object is to obtain a novel refuse recycling container unit of sufficiently small size as to be conveniently utilizable within small home spaces.

Another object is to obtain a novel refuse recycling container unit having aesthetically pleasing appearance, such that it can be used acceptably with a home or kitchen or the like.

Another object is to obtain a novel refuse recycling container unit providing for separation and/or segregation of different types of refuse at the time of collecting or depositing into the unit as the refuse becomes available.

Another object is to obtain a novel refuse recycling container unit providing for easy transferring of segregated refuse in a convenient readily separately-packaged state with a minimal of effort.

Another object is to obtain a novel refuse recycling container compact in nature, yet providing readily accessible openings to the separate segregated areas thereof.

Another object is to obtain a novel refuse recycling container unit providing a plurality of separate containers.

Another object is to obtain a novel refuse recycling container unit easily storable in minimal space when empty.

Another object is to obtain a novel refuse recycling container unit that is easily handled and transortable in the filled state, by persons such as house wives.

Another object is to obtain a novel refuse recycling container unit composed of a minimal number of elements, such that use and storage is simplified, and danger of loss of necessary elements is minimized.

Another object is to achieve the foregoing objects together with maintaining minimal cost of production and sale to the consumer, of the novel refuse recycling container unit of the present invention.

SUMMARY OF THE INVENTION

Broadly the invention may be described as a recycling container unit that includes an upright outer vessel, a plurality of upright inner vessels, and an anchoring mechanism providing the intermittently detachably mounting each of the plurality of inner vessels to the side wall of the outer vessel, described in greater detail below. The upright outer vessel has a top opening (open top) of a cross-section sufficiently large to receive therethrough simltaneously the plurality of upright inner vessels in side-by-side relationship to one-another. The upright outer vessel is formed by upright wall-structure forming an inner-space thereof that joins with the open top. The inner space formed by the upright wall-structure is of sufficient volume to receive and seat the plurality of inner vessels, in side-by-side relationship. The upright outer vessel has a bottom-structure positioned and adapted to seat the plurality of upright inner vessels thereon when the upright inner vessels are seated within the upright outer vessel. Each of the upright inner vessels has an open top of sufficient cross-sectional area to receive contents therethrough into inner space thereof. The upright inner space of each of the upright inner vessels is of sufficient volume to receive and contain contents therein, typically as shown in the Figures. The anchoring mechanism is a mechaism by which the individual upright inner vessels are each detachably attached to the outer vessel's above-noted upright wall-structure such that intermittently the upright inner vessel when empty may be inserted and attached to the outer-vessel wall-structure until it is subsequently filled and ready for transporting. At the place of emptying into a larger container, or for being pick-up by a pick-up municipal or other government agency's truck, the contents is emptied therefrom followed by reinserting the empty upright inner vessel back into the outer vessel.

Preferably the anchoring mechanism is a simple male-female joint-type unit, one of the male and female members being on the outer-surface wall of the upright inner vessel, and the remaining other one of the male and female member being a part of the wall-structure of the upright outer vessel. There preferably is a separate male-female mechanism for each of the upright inner vessels.

In a more preferred embodiment, the male member extends laterally from an upper side or top-edge of the upright inner vessel, and the female member is made-up more preferably of an upwardly-extending slot (in the outer vessel's wall structure) having an open upper end extending through a top surface of the wall-structure of the outer vessel, such that the male member's shaft merely easily slides downwardly into the slot, with the head or enlarged distal end of the male structure locking the upright inner vessel against the inside surface of the wall-structure. Also more preferably, the male member has an enlarged or wider terminal end or head, such that sliding the shaft downwardly into the slot with the head on the exterior of the wall-structure, the upright inner-vessel becomes locked onto the outer vessel's wall-structure.

For the upright outer vessel, there is a bottom thereto from which preferably there extends upwardly a spacing-structure positioned to maintain a spaced-relationship between adjacent ones of the upright inner vessels seated within the upright outer vessel. Also preferably, in one embodiment, the bottom of each upright inner vessel has a bottom surface configuration (shape) corresponding to or mateable with the shape of the upwardly-extending above-noted spacing-structure, i.e., one conforms to and seats in the other.

Preferably the upright inner vessels each have inner and outer wall surfaces and interior space tapering from the inner-vessel's top larger cross-section to a bottom smaller cross section.

Preferably the recycling container unit's upright outer vessel has outer and inner wall surfaces and interior space tapering downwardly from the outer-vessel's top larger cross-section to a bottom smaller cross-section.

Thereby, where both the outer and inner vessels taper to a smaller inner cross-section of their respective interior spaces, when a plurality of outer vessels are empty they may be stacked one into the other within a thereby reduced amount of space, and likewise the smaller inner vessels when empty may be stacked into one-another. Finally, the stack inner vessels may be stacked in the top one of a stack of outer vessels, further conserving storage space.

Preferably the upright outer vessel is cylindrical in shape, but tapering from larger top cross-section to bottom lesser cross-section as above-discussed already. The plurality of upright inner vessels therefor, are preferably a pie-shaped segment-configuration, whereby the plurality fit together like slices of a pie.

From the standpoint of conservation of the amount of required plastic or other material out of which the upright outer and inner vessels are produced, but particularly for plastic containers that may be made by molding, it is highly preferred that the bottom face (surface) of the upright outer vessel correspond to or conform to the opposite shape being made on the upper surface (face) of the inside bottom, such being easily achieved by molding techniques. Likewise, the upper face (surface) of the inside bottom of the upright inner vessel preferably oppositely corresponds in shape to the bottom face (surface) of the bottom of the upright inner vessel, likewise easy to conventionally mold that way, with the accompanying saving of plastic and overall production costs.

Other alternate configurations that may be desirable one over another depending upon the particular space in which it is to fit and/or depending upon how many upright inner vessels are concurrently needed for divisions of the refuse being collected, include upright outer vessels of top cross-sectional shapes such as triangular, square, rectangular and the like, with corresponding upright inner vessels having top cross-sectional shapes such as triangular, square, rectangular, and the like.

Preferably the upright outer shell includes one or more handles of any desired type, small unobstrusive preferably graspable handles on each of opposite side of the outer vessel near or at the top thereof.

Likewise, however, each upright inner vessel has one or more handles readily accessible and graspable when the upright inner vessel is mounted and/or seated within the upright outer vessel. Accordingly, also it is preferred that the upright inner vessels be slightly taller or higher than the upright outer vessel, in order that the handle(s) of the upright inner vessel be readily accesible and graspable when the upright inner vessel is seated within the upright outer vessel. Also, each of the upright inner vessels has on its handle, a readily-visibly-positioned substantially flattened surface for either writing thereon a label, or for receiving a labeling tab thereon, typically adheasively.

While small sizes are preferred for the upright outer vessel and their corresponding upright inner vessels, when for use in a home, such as in the kitchen, on the other hand, the invention applies equally to outside or larger collectors, where it is more desirable for the upright outer vessel to be much larger, and correspondingly for its inside upright inner vessels to be correspondingly also much larger—when used more in the context of a typical garbage can.

This invention can help to further the general cause of recycling by being recognizable by the passerby as a recycling unit, thereby helping to implant the thought of simplicity involved in recycling.

The upright outer vessels of this invention, and/or the upright inner vessels, may be manufactured from any plastic, fiberglass, metal, paper, cardboard or the like, or combinations thereof. Alternatively or concurrently, they may be made of recycled plastic or other recycled matter. Such a product made from recycled plastic would additionally help to create a tremendous boost to the confidence of consumers and participants of recycling, thus helping to encourage people to separate more plastics from their waste-refuse.

For any one or more of the inner vessels, plastic liner-bags may be inserted into the inner vessel, while turning-back (folding-back) the upper edge of the liner-bag over and onto the upper circumscribing edge of the upright inner vessel, thereby anchoring and suspending it from the top edge of the upright inner vessel.

The manufacture and distribution of the container vessels above-described of this invention, would have the effect of compounding a positive domino effect from one end of the recycling industry to the other. It is conceivable to reliably estimate that it could help to move millions of dollars worth of recycled materials through industry at considerably reduced cost to the local consumers, with greater efficiency and larger yields to the government collectors thereof. With the recycling container unit of this invention, more people would find it easier to recycle, therefore resulting in the collection of materials compounding. As a result, the collection services could generate more revenue, and thereupon hire more and better qualified employees and provide improved service from the view of both the home collectors and the collecting agency. Probably the greatest benefits that will result from the present invention, are the rapid resulting clean-up and maintaining of clean condition of the environment, by helping people to help themselves.

The invention may be better understood by making reference to the following Figures.

THE FIGURES

FIG. 1 diagrammatically illustrates a perspective side and top view of a preferred embodiment of the invention, with partial cut-aways for improved illustration of various features.

FIG. 2 diagrammatically illustrates a bottom view of the embodiment of FIG. 1.

FIG. 3 diagrammatically illustrates a top view of the empty upright vessel of FIG. 1.

FIG. 4 diagrammatically illustrates the pie-shaped segment-configuration of one of the upright inner vessels of the FIG. 1 embodiment.

FIG. 5 diagrammatically illustrates the side cross-sectional view of the upright inner vessel of FIG. 4, as taken-along line 5—5 thereof.

FIG. 6 diagramatically illustrates an alternative male-structure and female-structure for a typical anchoring mechanism previously described, for the invention, in a top in-part partial cross-sectional view of a portion of the upright outer vessel's wall-structure and the upright inner vessel's outer surface of its wall having a male structure extending therefrom.

FIG. 7 diagrammatically illustrates an alternate embodiment to that of FIG. 6, in which the male and female structures are reversed from that shown in FIG. 6, and represents likewise a top in-part partial cross-section view of a portion of the upright outer vessel's wall-structure and the upright inner vessel's outer surface, with the male structure extending radially inwardly.

FIG. 8 diagrammatically illustrates a side cross-sectional view as taken through the embodiment of FIG. 6, illustrating the fit of the upright inner vessels within the interior space of the upright outer vessel, shown in in-part view.

FIG. 9 diagrammatically illustrates an alternate embodiment to that of FIGS. 6 and 8, as an inside bottom cross-sectional view of the embodiment of FIG. 10 as taken along line 9—9 of FIG. 10, particularly illustrating the central upwardly-extending spacing structure.

FIG. 10 diagrammatically illustrates a side cross-sectional view taken along line 10—10 of FIG. 9.

FIG. 11A diagrammatically illustrates the top view of an alternate embodiment to that of FIG. 1.

FIG. 11B diagrammatically illustrates a square alternate embodiment, in top view.

FIG. 11C diagrammatically illustrates in top view a triangularly-shaped alternate embodiment.

FIG. 11D diagrammatically illustrates in top view a rectangularly-shaped upright outer vessel containing square-shaped upright inner vessels.

DETAILED DESCRIPTION

With regard to the several different embodiments of the foregoing Figures, related indicia are utilized to identify corresponding elements in different embodiments, and once described for one embodiment, description is not repeated for other embodiments except for purposes of improving understanding and illustration.

Figure 3:
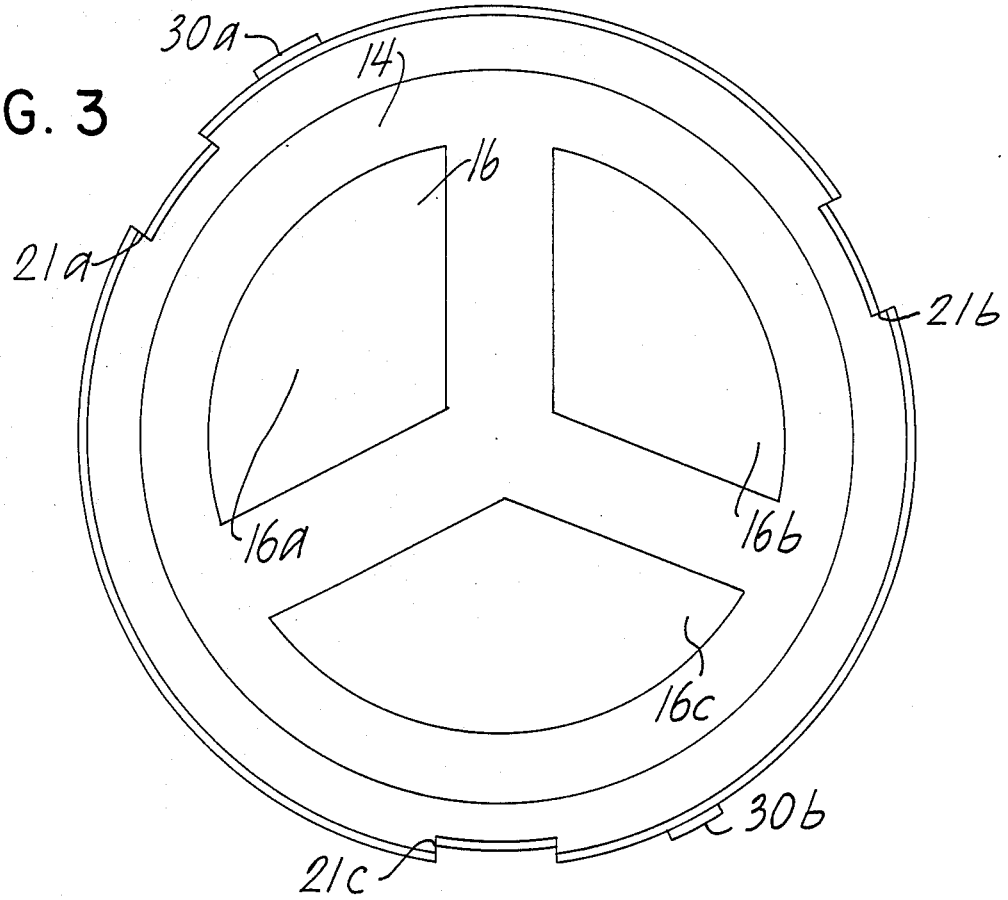

FIGS. 1, 2, 3 and 4 represent a common embodiment, although FIG. 3 illustrates solely the upright outer vessel 25 of FIG. 1.

Accordingly, FIG. 1 shows the entire recycling container unit 11. The upright outer vessel 25 has side handles 30*a* and 30*b* (30*b* not visible, but shown in FIGS. 2 and 3), the upright outer vessel's female-forming structure 22″*a* forming female-receptacle space 21*a*. Upright inner vessel's male-structure 22 is shown to have a wider distal-end portion with the narrower proximal end thereof mounted within the female-receptacle space 21*a*; male-structure 22 is shown in partial cut-away from the upright inner vessel 12″ in order to improve illustration and understanding. Corresponding male-structure 22 of upright inner vessel 12 and male-structure 22′ of upright inner vessel 12′ are likewise illustrated. The respective upright inner vessels 12, 12′ and 12″ are shown to have their respective corresponding handles 24, 24' and 24" extending from the top edge of the wall structure of the respective upright inner vessels. Locations 54*a*, 54*b* and 54*c* of the respective handles 24, 24' and 24", are flat readily visible surfaces provided to receive appropriate labeling thereon, such as by writing thereon or by typically applying thereto a label (not shown) such as a label having an adheasively-coated back-face (not shown).

The upright inner vessel 12" has its outer arcuately-shaped side 24" (see FIGS. 4 and 5) having upper rim-flange 19"*a*, a linearly-extending side 17"*a* having upper rim-flange 19"*b* and another linearly-extending side 17"*b* having upper rim flange 19"*c*. Upright inner vessels 12 and 12' have correspondingly-shaped sides. Each upright inner vessel has its upper opening 26 thereof, and the corresponding upper surfaces of the floor, such as 15" of inner vessel 12'. The upright inner vessels each have their linearly-extending walls such as walls 17"*a* and 17"*b* meeting and joining at corner 18". Correspondingly the wall 17*a* is identified for upright inner vessel 12.

At an upper edge of each of the upright inner vessels 12, 12' and 12", there is a rim-like laterally(outwardly)-extending flange such as flanges 19"*a*, 19"*b* (see FIGS. 1 and 5) and 19"*c*.

The upright outer vessel 25 has for each of the corresponding upright inner vessels 12, 12' and 12" upwardly-extending spacer structure for maintaining the respective upwardly-extending vessels in spaced-relationships to each other when in their seated positions within the upright outer vessel 25. Correspondingly, the bottom face of each of the upright inner vessels has a conforming seatable shape substantially corresponding to and seatably fitting the upwardly-extending spacing structure of the upper inner face of the floor of the upright outer vessel 25. Accordingly illustrated for the upright inner vessel 12" as illustrated at the cut-away portion, the upright outer vessel 25 has upper surface of the floor-spacing structure 16 that conforms to and seats within the recessed lower face of the raised floor portion 15" of the upright inner vessel 12", the raised floor portion 15" being raised above the lower outer floor portions 13"*a*. The spacing structure 16 is raised from the lower floor structure (upper face) 14 of the upright outer vessel 25.

Figure 2:
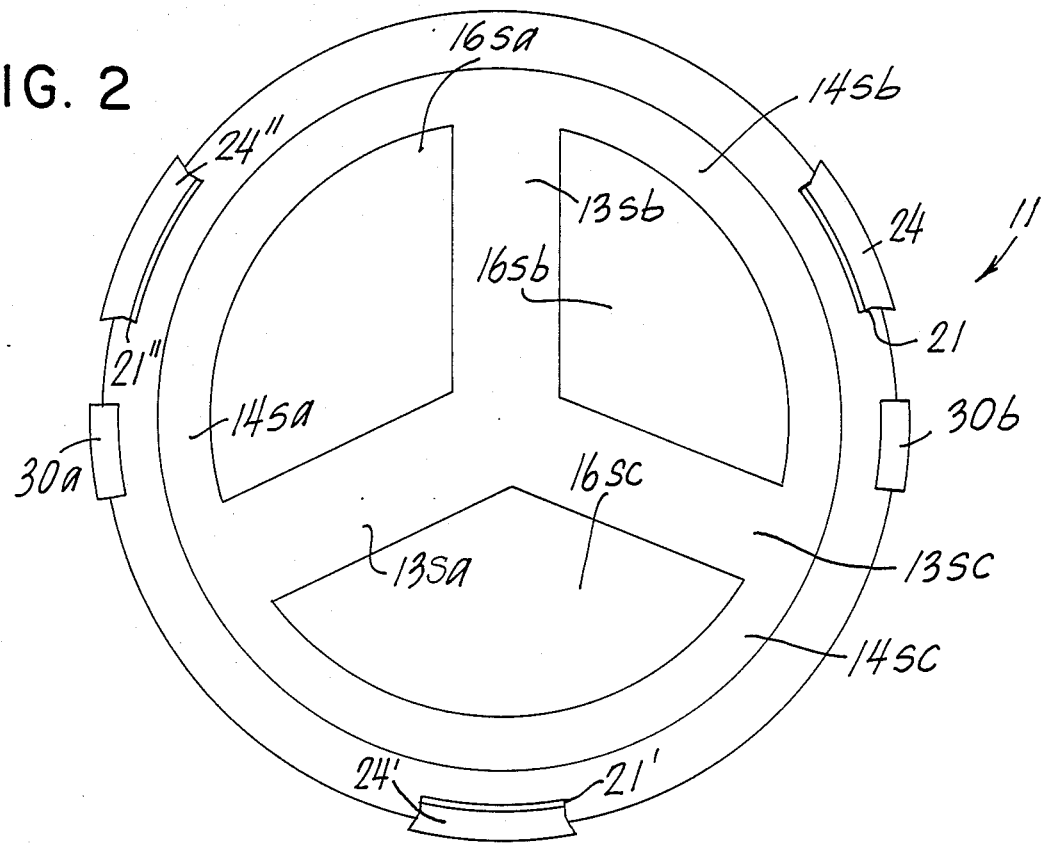

FIG. 2 illustrates the bottom view of the entire unit illustrated in FIG. 1, showing the bottom-face separate sections 16*sa*, 16*sb*, and 16*sc* of the upright inner vessels's inner spacing structures (generically) 16, as well as for the lower surface (face) of the lower-floor 14, showing the segmented lower portions 14*sa*, 14*sb* and 14*sc*. Also, the female spaces 21, 21' and 21" are illustrated for the upright outer vessel. Also shown is the handle 30*a* not visible in FIG. 1, of the upright outer vessel. Also shown are the intermediate radially-outwardly-extending portions 13*sa*, 13*sb* and 13*sc* for the conforming-shapes of the exterior bottom face of the upright outer vessel.

FIG. 3 illustrates a top view of solely the upright outer vessel of FIGS. 1 and 2, showing the corresponding upper-surface sections 16*a*, 16*b* and 16*c* of generically-identified spacer-structure 16, and the upper surface of the lower floor-portion 14 previously identified for FIG. 1.

Figure 4:
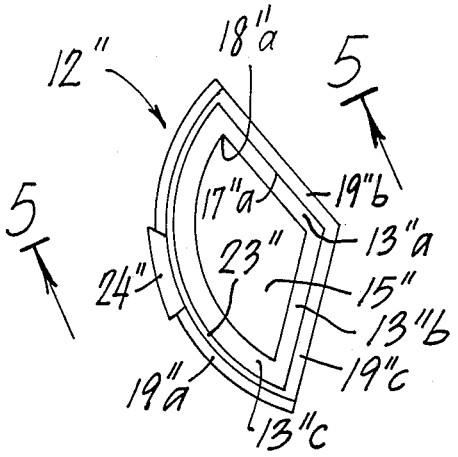

FIG. 4 illustrates for the upright inner vessel 12" the several portions of inner lower-floor surface, namely 13"*a*, 13"*b* and 13"*c*. Also corner 18"*a* is identified, where arcuate wall 23 joins linearly-extending wall 17"*a*.

Figure 5:
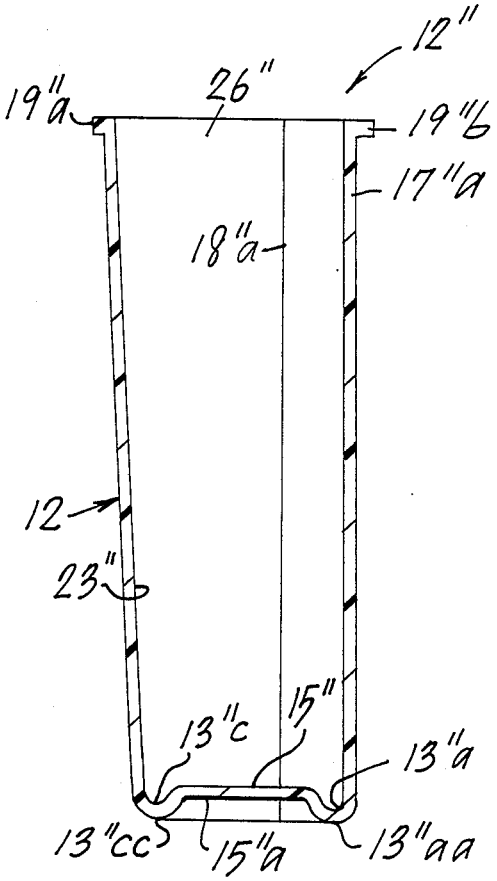

FIG. 5 illustrates a cross-sectional view taken along line 5—5 of FIG. 4. This Figure also shows the conforming shape (as shown in FIG. 1) of the bottom face of the upright inner vessel 12", namely the lower portions 13"*aa* and 13"*cc* of the lower face of the floor(bottom) and the lower face 15"*a* of the upper face(surface) 15", previously generically identified as 15, previously also identified in FIG. 4 as 15". This Figure also, as previously noted, illustrates the rim-like flange 19"*b* of side 17"*a*.

Figure 6:
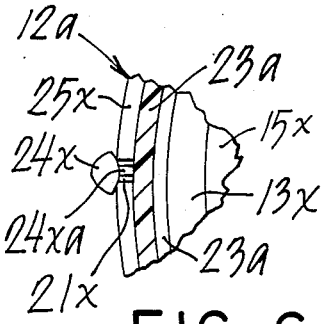

FIG. 6 shows an alternate embodiment, in which the male structure is shaped as a shaft 24*xa* extending outwardly from the upright inner vessel wall 23*a*, and the terminal end's head 24*x*, with the shaft 24*xa* seated within the female-space 21*x* and locked-therein by the larger head 24*x*. The enlarged head has a larger diameter or width than the female slot-space 21*x*, thereby locking the inner vessel's wall 23*a* against the outer vessel wall 25*x*.

Figure 7:
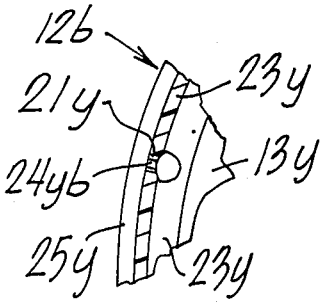

FIG. 7 illustrates a different embodiment, having a reverse relationship to that of FIG. 6, in which the shaft 24*yb* extends radially inwardly from the upright outer vessel wall 25*y*, extending into the slot-space 21*y* of upright inner vessel wall 23*y*.

Figure 8:
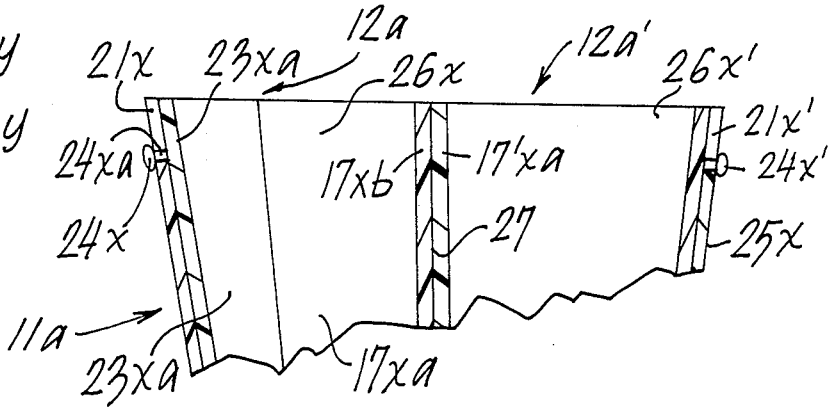

FIG. 8 illustrates an embodiment having the male-female structures-embodiment of FIG. 6, and further illustrating an embodiment in which the upright inner vessels do not extend above the top edge of the upright outer vessel, and in which the adjacent walls 17*xb* and 17'*xa* are in touching relationship 27 for upright inner vessels 12*a* and 12*a*', for the unit 11*a*.

FIG. 9, taken along line 10—10 of FIG. 10, illustrates an embodiment in which a spacing structure extends upwardly from the upper face(s) 29*a*, 29*b* and 29*c* of the floor of the upright outer vessel 25*z*, as separate legs 28*a*, 28*b* and 28*c*, spacing the upright inner vessels's radially-outwardly-extending walls from one-another—such as spaced walls 19*zb* spaced from wall 19*za*', and wall 19*za* spaced from wall 19*zzb*, and wall 19*zza* spaced from wall 19*zb*'.

FIG. 10, taken along line 10—10 of FIG. 9, illustrates a unit 11*b* which likewise includes the male-female structures-embodiment of FIG. 6, and likewise the upright inner vessel's do not extend above the upper edge of the upright outer vessel, but the upright inner vessels 12*aa* and 12*ab* flush and touching at the top edges thereof but spaced-apart by spacer 29*a* extending upwardly from the floor-structure 25*zz* of the upright outer vessel.

Figure 11A:
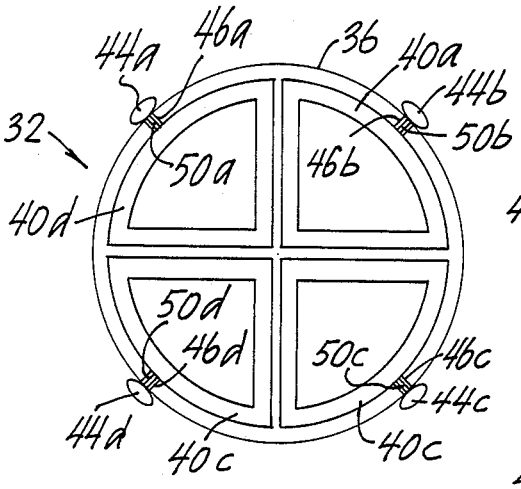
Figure 11B:
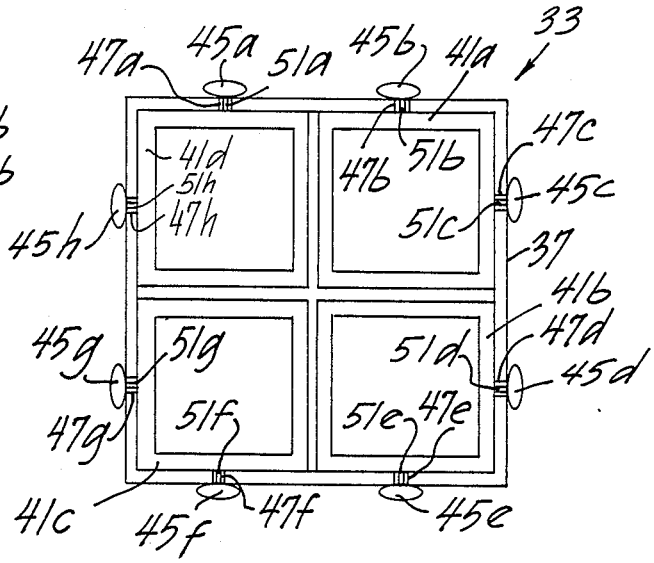
Figure 11C:
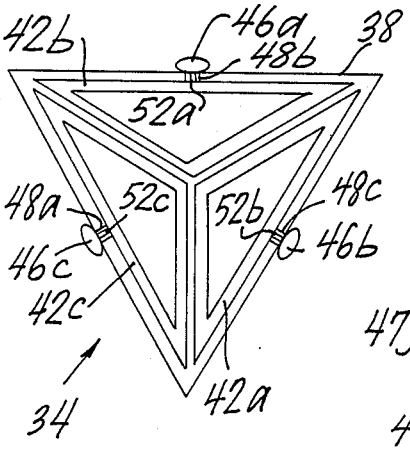
Figure 11D:
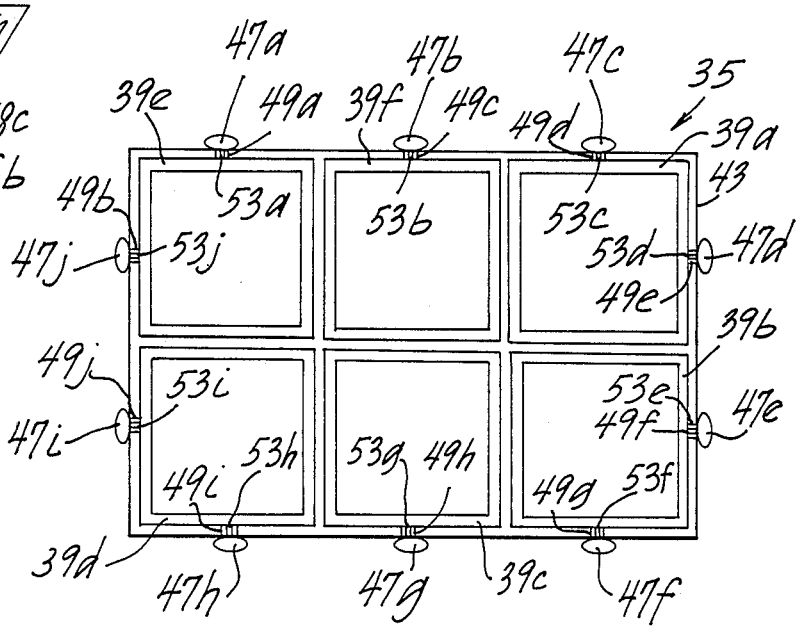

FIGS. 11A through 11D each embody the male-female structures of the FIG. 6, embodiment, but differ from one-another in their shapes of the upright outer vessels and their respective upright inner vessels as shown. These varying shapes are the theme of these Figures, FIG. 11*a* disclosing a circular upright outer vessel, the FIG. 11B disclosing a squared upright outer vessel, the FIG. 11C illustrating a triangularly-shaped upright outer vessel, and the FIG. 11D disclosing a rectangularly-shaped upright outer vessel. The FIG. 11A embodiment has upright inner vessels each having a pie-shaped segment-configuration. The FIG. 11B and the FIG. 11D each disclose upright inner vessels each having squared configuration. The FIG. 11C illustrates the upright inner vessels as each having triangular configurations.

It is within the scope of this invention to make such variations and substitution of equivalents, as would be obvious to a person of ordinary skill in this particular art.

I claim:

1. A recycling container unit comprising in combination: (a) an upright outer vessel having a first open-top of a first predetermined cross-section sufficient to receive therethrough a first plurality of upright inner vessels in side-by-side relationship to one-another, said upright outer vessel having outer vessel-forming upright wall-structure forming a first inner-space opening into said first open-top and of sufficient first inner-volume space to receive said plurality in side-by-side relationships to one-another, (b) said first plurality of said upright inner vessels having inner-vessel cross-sectional dimensions such that the first plurality are receivable and seatable within said upright outer vessel in said first inner-space in side-by-side relationship, each of said upright inner vessels having a second open-top of second cross-sectional area sufficient to receive contents therethrough, each of said upright inner vessels having second inner-space opening into said second open-top, each of said upright inner vessels having sufficient second inner-volume space to receive and contain contents therein, and (c) anchoring means for intermittently detachably-mounting said first plurality in predetermined positions on said upright outer vessel upright wall-structure when said first plurality are within said first inner-volume space, said predetermined positions being said first plurality uprightly positioned in said side-by-side relationship, said anchoring means comprising intermittently interlockable male-structure and female slot-forming structure, one of said male-structure and said female slot-forming structure being on said inner-vessel wall-structure, and a remaining one of said male-structure and said female slot-forming structure being on one of said inner-vessel walls, positioned such that said male-structure and said female slot-forming structure are aligned and interlockable when said first plurality are seated within said first inner-volume space.

2. A recycling container unit comprising in combination: (a) an upright outer vessel having a first open-top of a first predetermined cross-section sufficient to receive therethrough a first plurality of upright inner vessels in side-by-side relationship to one-another, said upright outer vessel having outer vessel-forming upright wall-structure forming and first inner-space opening into said first open-top and of sufficient first inner-volume space to receive said plurality in side-by-side relationships to one-another; (b) said first plurality of said upright inner vessels having inner-vessel cross-sectional dimensions such that the first plurality are receivable and seatable within said upright outer vessel in said first inner-space in side-by-side relationship, each of said upright inner vessels having a second open-top of second cross-sectional area sufficient to receive contents therethrough, each of said upright inner vessels having second inner-space opening into said second open-top, each of said upright inner vessels having sufficient second inner-volume space to receive and contain contents therein; and (c) anchoring means for intermittently detachably-mounting said first plurality in predetermined positions on said upright outer vessel upright wall-structure when said first plurality are within said first inner-volume space, said predetermined positions being said first plurality uprightly positioned in said side-by-side relationship, said anchoring means comprising intermittently interlockable male-structure and female slot-forming structure, one of said male-structure and said female slot-forming structure being on said outer-vessel wall-structure, and a remaining one of said male-structure and said female slot-forming structure being on one of said inner-vessel walls, positioned such that said male-structure and said female slot-forming structure are aligned and interlockable when said first plurality are seated within said first inner-volume space.

3. A recycling container unit of claim 2, in which said wall structure has an upper edge and an exterior surface, and in which a rim-like flange extends laterally from said exterior surface substantially at said upper edge.

4. A recycling container unit of claim 2, in which said anchoring means includes a separate paired-set of said interlockable male-structure and female slot-forming structure for each of said inner vessels of said first plurality.

5. A recycling container unit of claim 4, in which said upright wall-structure terminates as a top surface of the outer vessel as a top edge, and in which said male-structure has an enlarged distal end and a narrower intermediate shaft portion, and in which said female slot-forming structure forms an upwardly-extending open-ended slot extending through said top surface.

6. A recycling container unit of claim 4, in which each of said upright outer vessel and said upright inner vessels has a separate handle accessible to be grasped when the upright inner vessels are seated within said first inner-volume space of said upright outer vessel.

7. A recycling container unit of claim 6, in which each said inner vessel bottom-structure is shaped to embody a female receptacle structure mateably receivable of said upwardly-extending spacing structure.

8. A recycling container unit of claim 7, in which said inner upper face includes a second plurality of said inner vessel bottom-structures, each of said second plurality being positioned to mate as a male member into one of said female receptacle structures of said first plurality of upright said inner vessels.

9. A recycling container unit of claim 6, in which said upright inner vessels have heights greater than said upright outer vessel.

10. A recycling container unit of claim 8, in which each said upright inner vessel's handle has a readily-visibly-positioned substantially flattened labeling surface.

11. A recycling container unit of claim 6, in which each said upright inner vessel's handle has a readily-visibly-positioned substantially flattened labeling surface.

12. A recycling container unit of claim 12, in which said upright outer vessel has an upper portion forming said first open-top, shaped such that said first open-top has a circular configuration, and in which each said upright inner vessel has an upper portion forming said second open-top shaped such that said second open-top has a pie-shaped segment-configuration.

13. A recycling container unit of claim 12, in which said upright outer vessel has an upper portion forming said first open-top shaped such that said first open-top has a square configuration, and in which each said upright inner vessel has an upper portion forming said second open-top shaped such that said second open-top hs a square configuration.

14. A recycling container unit of claim 12, in which said upright outer vessel has an upper portion forming said first open-top shaped such that said first open-top has a triangular configuration, and in which each said upright inner vessel has an upper portion forming said second open-top shaped such that said second open-top has a triangular configuration.

15. A recycling container unit of claim 12, in which said upright outer vessel has an upper portion forming said first open-top shaped such that said first open-top has a rectangular configuration.

16. A recycling container unit of claim 12, in which said upright inner vessels each have inner and outer wall surfaces and interior space from inner-vessel top larger cross-section to a bottom smaller cross section.

17. A recycling container unit of claim 12, in which said upright outer vessel has outer and inner wall surfaces and interior space from outer-vessel top larger cross-section to a bottom smaller cross-section.

18. A recycling container unit of claim 12, in which said upright inner vessels of said first plurality each has inner-vessel bottom-structure and walls extending upwardly therefrom, and in which said upright outer vessel includes an outer-vessel bottom-structure and outer-vessel walls extending upwardly therefrom, said outer-vessel bottom-structure having an inner upper face including upwardly-extending spacing-structure positioned such that said upright inner-vessel bottom structures of said first plurality are maintained spaced-from one-another in a seated-relationship adjacent said outer-vessel walls.

19. A recycling container unit of claim 18, in which said upright outer vessel bottom has an outer lower face that conforms in shaped to said inner upper face.

20. A recycling container unit of claim 18, in which each said inner vessel bottom-structure is shaped to embody a female receptacle structure mateably receivable of said upwardly-extending spacing structure.

21. A recycling container unit of claim 20, in which said inner upper face includes a second plurality of said inner vessel bottom-structures, each of said second plurality being positioned to mate as a male member into one of said female receptacle structures of said first plurality of said upright inner vessels.

* * * * *